United States Patent [19]

Kanagawa et al.

[11] Patent Number: 5,066,976

[45] Date of Patent: Nov. 19, 1991

[54] IMAGE FORMING APPARATUS HAVING A PRINT CARTRIDGE

[75] Inventors: Takashi Kanagawa; Yutaka Shiino; Tetsuya Furuyama, all of Kanagawa, Japan

[73] Assignee: Fuji Xerox Co., Ltd., Tokyo, Japan

[21] Appl. No.: 672,977

[22] Filed: Mar. 14, 1991

[30] Foreign Application Priority Data

Mar. 19, 1990 [JP] Japan ..... 2-69203

[51] Int. Cl.[5] ..... G03G 15/00

[52] U.S. Cl. ..... 355/200; 355/211

[58] Field of Search ..... 355/200, 210, 211; 346/160, 160.1

[56] References Cited

U.S. PATENT DOCUMENTS

| | | | |
|---|---|---|---|
| 4,616,920 | 10/1986 | Itoigawa et al. | 355/200 |
| 4,668,072 | 5/1987 | Yasuda | 355/211 |
| 4,708,455 | 11/1987 | Kubota et al. | 355/211 |
| 4,952,989 | 8/1990 | Kawano et al. | 355/210 |
| 4,969,010 | 11/1990 | Tamura et al. | 355/200 X |

FOREIGN PATENT DOCUMENTS

| | | | |
|---|---|---|---|
| 56-87056 | 7/1981 | Japan | 355/200 |
| 59-61847 | 4/1984 | Japan | 355/210 |
| 59-61859 | 4/1984 | Japan | 355/210 |
| 60-8855 | 1/1985 | Japan | 355/200 |
| 60-63550 | 4/1985 | Japan | 355/211 |
| 62-65049 | 3/1987 | Japan . | |
| 1-237671 | 9/1989 | Japan . | |

*Primary Examiner*—A. T. Grimley
*Assistant Examiner*—Shuk Y. Lee
*Attorney, Agent, or Firm*—Finnegan, Henderson, Farabow, Garrett and Dunner

[57] ABSTRACT

An image forming apparatus comprises an apparatus body having a guide rail and a print cartridge movable along the guide rail, in which the guide rail has an engaging portion, the print cartridge includes a holder member and a cover for covering the holder member, the cover having a notched portion and the holder member having an engagement portion which is adapted to be pushed so as to be engaged with the engaging portion of the guide rail, the holder member having an operating portion which is responsive to the engagement of the engagement portion with the engaging portion so as to be moved into and out of the cover through said notched portion of the cover. Since the print cartridge slides along the guide rail provided on the apparatus body, and therefore the print cartridge can be easily attached to and detached from the apparatus body. And besides, when the print cartridge is pushed into the predetermined position in the apparatus body, the engagement portion of the holder member is engaged with the engaging portion of the guide rail so that the print cartridge is prevented from withdrawing from the apparatus body due to vibration or the like during the operation.

4 Claims, 6 Drawing Sheets

IMAGE FORMING APPARATUS HAVING A PRINT CARTRIDGE

BACKGROUND OF THE INVENTION

This invention relates to a print cartridge attaching device by which an image carrying body and at least one image forming device in an image forming apparatus, such as an electrophotographic copying machine and a printer, can be integrallly withdrawn from and inserted into a body of the apparatus.

In a known image forming apparatus, image forming devices, such as a primary static charger, an image exposing portion, a developing device, a transfer static charger and a cleaner, are arranged around the periphery of an image carrying body. After the surface of the image carrying body is uniformly electrostatically charged by the primary static charger, the image is exposed to form an electrostatic latent image, and this electrostatic latent image is developed by the developing device into a visible image. This visible image is transferred to paper by the transfer static charger. The paper is fed to a fixing device for fixing purposes, and the residual toner on the image carrying body is cleaned off by the cleaner.

In such an image forming apparatus, the lifetime of the image carrying body as well as the lifetime of the image forming devices are short, and they need to be periodically inspected, repaired and exchanged. For example, as disclosed in Japanese Laid-Open (Kokai) Patent Application No. 65049/87, an image carrying body and some of image forming devices are integrally formed into a print cartridge, and the print cartridge is removably attached to the body of the apparatus, thereby facilitating a maintenance such as inspection, repair and exchange operations.

Such attachment and detachment operation is expected to be done not only by service staff but also by an ordinary user, and therefore it is desirable to carry out such attachment and detachment without the need for cumbersome operation. For example, as disclosed in Japanese Laid-Open Patent Application No. 237671/89, a print cartridge can be inserted into and withdrawn from an apparatus body by the use of slide rails. With this arrangement, however, when the print cartridge is inserted into the apparatus body to be attached thereto, the print cartridge may be withdrawn therefrom due to vibration or the like.

SUMMARY OF THE INVENTION

It is therefore an object of this invention to provide a print cartridge attaching device for an image forming apparatus which overcomes the above problems, whereby a print cartridge can be inserted into and withdrawn from an apparatus body with simple operation, and the inserted print cartridge will not be withdrawn by vibration or the like.

According to the present invention, an image forming apparatus comprises an apparatus body having a guide rail and a print cartridge movable along the guide rail, in which the guide rail has an engaging portion, the print cartridge includes a holder member and a cover for covering the holder member, the cover having a notched portion and the holder member having an engagement portion which is adapted to be pushed so as to be engaged with the engaging portion of the guide rail, the holder member having an operating portion which is responsive to the engagement of the engagement portion with the engaging portion so as to be moved into and out of the cover through said notched portion of the cover.

According to the present invention, since the print cartridge slides along the guide rail provided on the apparatus body, and therefore the print cartridge can be easily attached to and detached from the apparatus body. And besides, when the print cartridge is pushed into the predetermined position in the apparatus body, the engagement portion of the holder member is engaged with the engaging portion of the guide rail so that the print cartridge is prevented from withdrawing from the apparatus body due to vibration or the like during the operation.

DESCRIPTION OF THE PREFERRED EMBODIMENT

Figure 3:
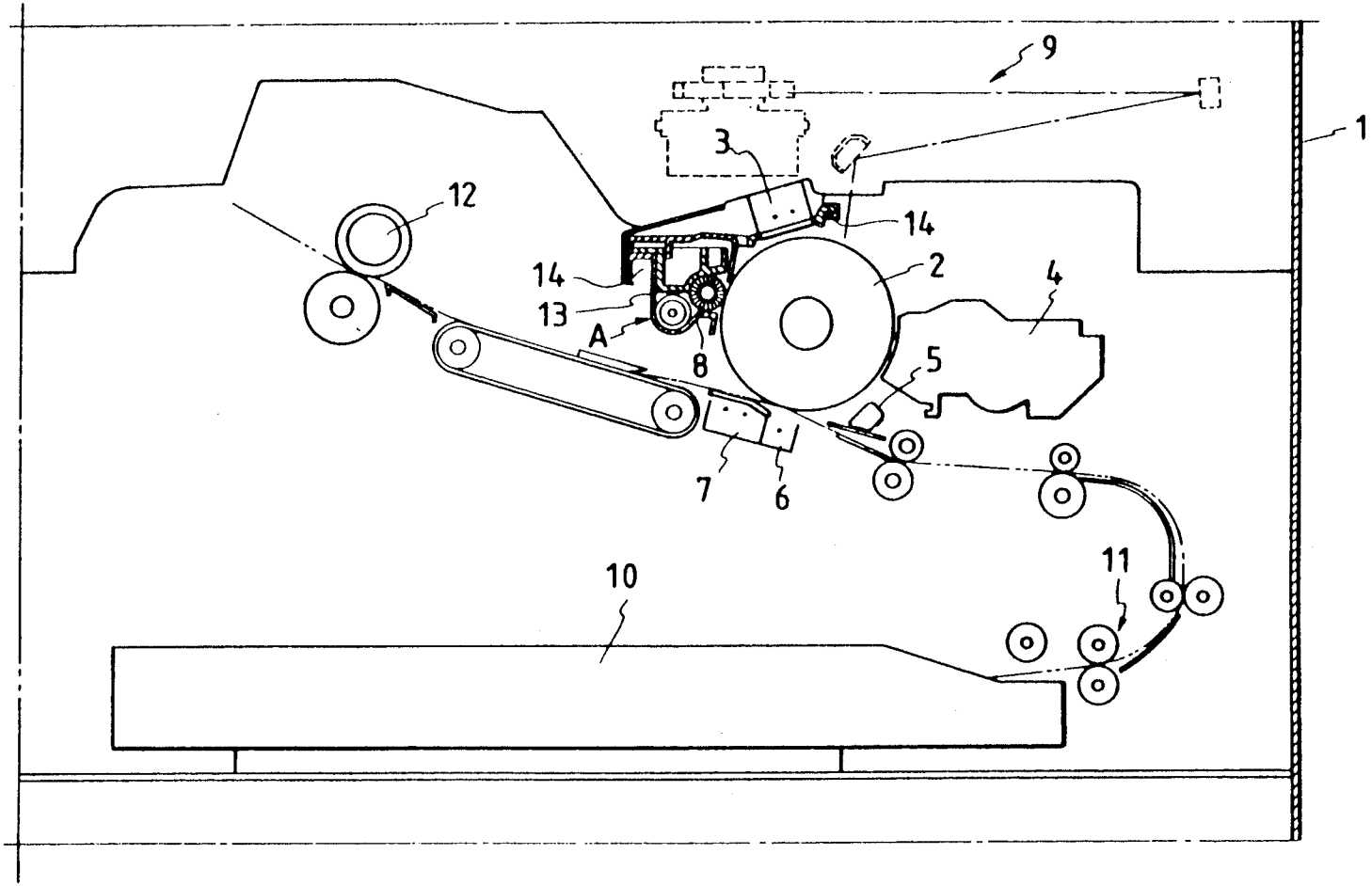
FIG. 3 is a schematic view of an image forming apparatus.
Figure 4:
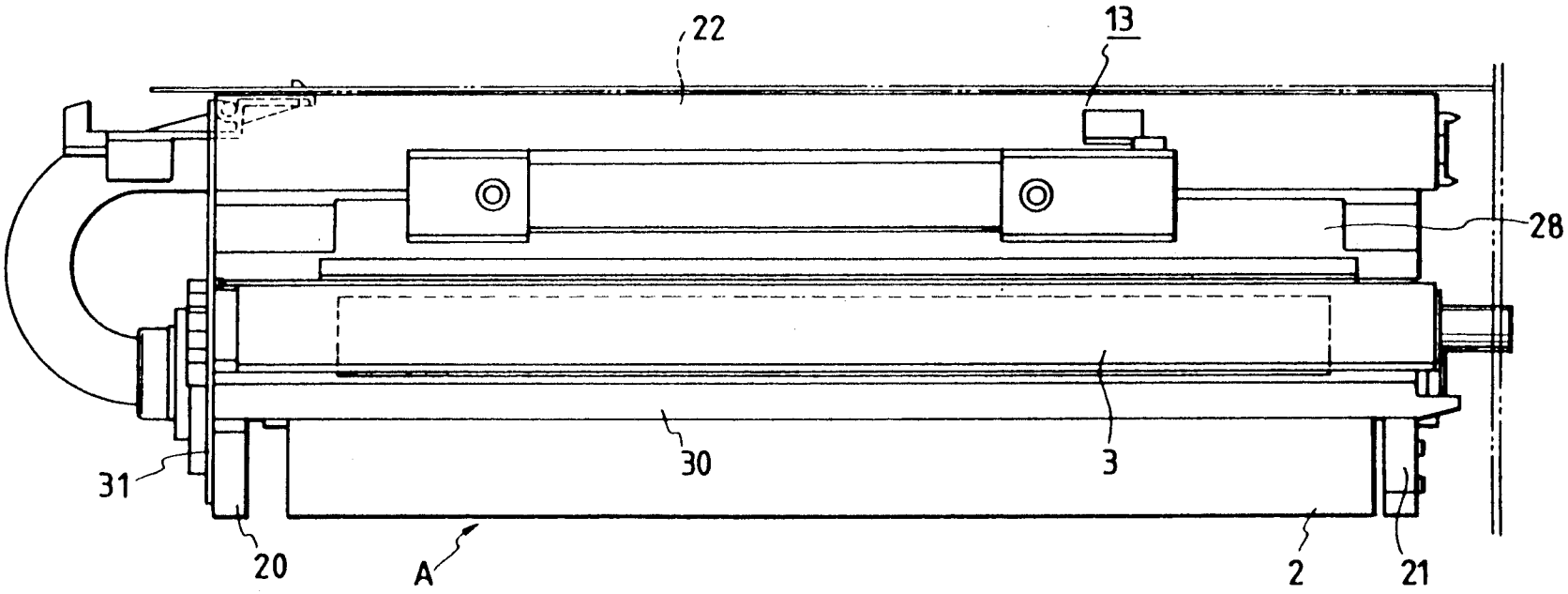
FIG. 4 is a plan view of a print cartridge.
Figure 5:
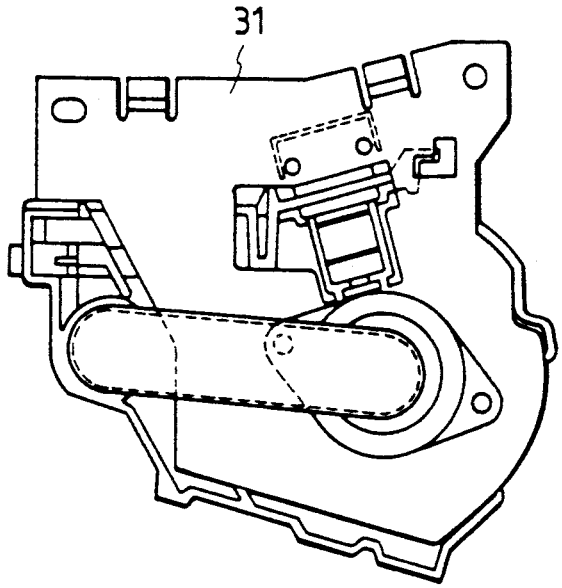
FIG. 5 is a left side view of the print cartridge.
Figure 6:
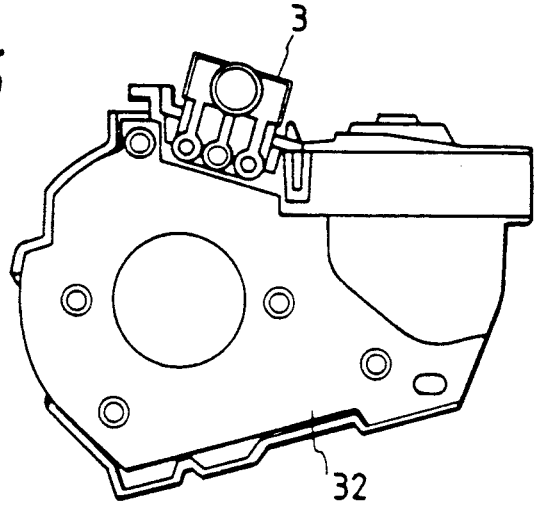
FIG. 6 is a right side view of the print cartridge.
Figure 7:
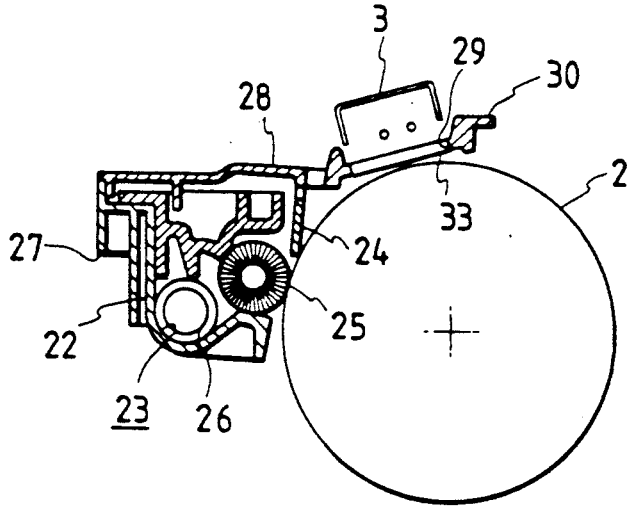
FIG. 7 is a vertical cross-sectional view of the print cartridge.

FIG. 3 is a schematic view explanatory of an image forming apparatus. An image carrying body 2 is provided on an apparatus body 1, and a primary static charger 3, a developing device 4, a pre-transfer static charger 5, a transfer static charger 6, a separating static charger 7, a cleaner 8 and the like, are sequentially arranged around the image carrying body 2. After the surface of the image carrying body 2 is uniformly electrostatically charged by the primary static charger 3, an image exposure is carried out by an image exposing mechanism 9 to thereby form an electrostatic latent image. The electrostatic latent image is developed by the developing device 4 into a visible image. Paper in a paper tray 10 is fed by a paper feed mechanism 11 toward the image carrying body 2, and the above visible image is transferred by the transfer static charger 6 to the paper, and the paper is fed to a fixing device 12 where the paper is fixed to provide a copy.

The image exposing mechanism 9 is of the laser type comprising a laser beam generator, a rotary mirror, and a plurality of mirrors. This image exposing mechanism receives image information from an external office automation device, such as a computer and a word processor, so as to expose an image on the image carrying body.

The image carrying body 2, the primary static charger 3 and the cleaner 8 are mounted on a housing 13 to constitute a print cartridge A. The housing 13 is insertable and withdrawable along guide rails 14 mounted on the apparatus body 1 so that the print cartridge A is withdrawable from and insertable into the apparatus body 1.

As shown in FIGS. 4 to 7, the housing 13 has a first side plate 20, a second side plate 21 and a peripheral wall 22. The peripheral wall 22 has a cleaner housing 23 in which a cleaning blade 24, a disturber brush 25, which has an annular brush, and an auger 26 are provided. The peripheral wall 22 has a first side slide rail 27. A cover member 28 is mounted between the first side plate 20 and the second side plate 21 over the upper surfaces thereof. An open window 29 is longitudinally formed through the cover member 28, and a projected end portion of the cover member 28 serves as a second side slide rail 30. A positioning side plate 31 is mounted on the first side plate 20, and a side plate 32 is mounted on the second side plate 21. The primary static charger 3 is mounted on the cover member 28, and a grid 33 of the primary static charger 3 is mounted between the cover member 28 and the upper surfaces of the first and second side plates 20 and 21.

With this construction, the first side slide rail 27 and the second side slide rail 30 of the housing 13 are slidable respectively along the guide rails 14, provided on the apparatus body 1, in the axial direction of the image carrying body 2.

Figure 1:
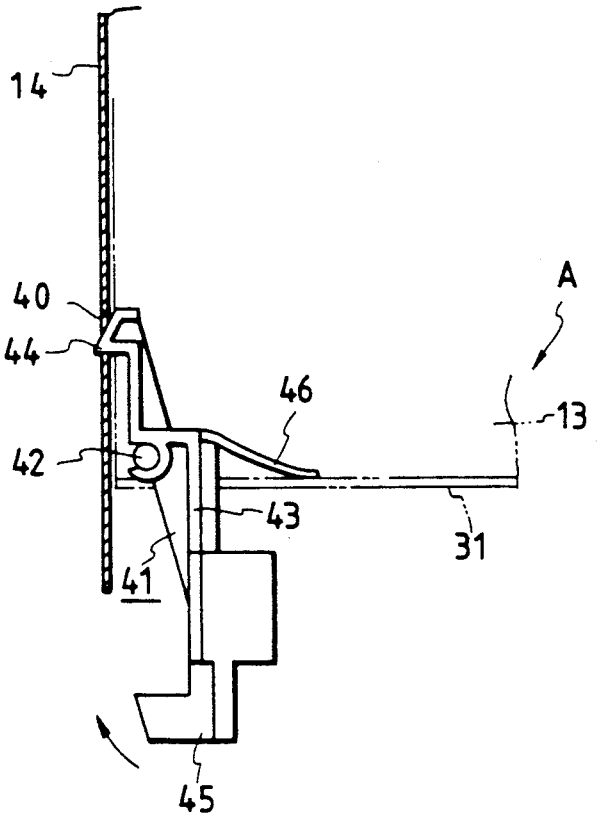
FIG. 1 is a plan view of a holder member-mounting portion.

As shown in FIG. 1, an engaging portion (for example, a notched portion 40) is formed at one guide rail 14, and a holder member 41 is provided at the proximal end portion of the housing 13 which constitutes the print cartridge A. A body 43 of the holder member 41 is pivotally supported by a pin 42 on the housing 13. An engagement portion (for example, a hook 44) is formed on the distal end of the body 43, and an operating portion 45 is formed at the proximal end of the body 43, and a resilient piece 46 is provided at the intermediate portion of the body 43. The resilient piece 46 is abutted against a portion (for example, the positioning side plate 31) of the housing 13 so as to pivotally urge the holder member 41 in an engaging direction.

With this construction, by sliding the first side and second side slide rails 27 and 30, provided on the housing 13, along the respective guide rails 14 provided on the apparatus body 1, the print cartridge A is inserted into the apparatus body 1 to be brought into a predetermined position where the hook 44 of the holder member 41 is engaged in the notched portion 40 of the guide rail 14 to thereby hold the housing 13. Therefore, the print cartridge A will not be withdrawn from the apparatus body 1 by vibration or the like during the operation.

The operating portion 45 is grasped, and the holder member 41 is pivotally moved in a direction of an arrow, so that the hook 44 is disengaged from the notched portion 40. Thus, the print cartridge A can be withdrawn from the apparatus body 1.

From the viewpoint of the image formation, the notched portion 40 in the guide rail 14 is provided at such a position as not to affect the effective area of each function part.

Figure 2:
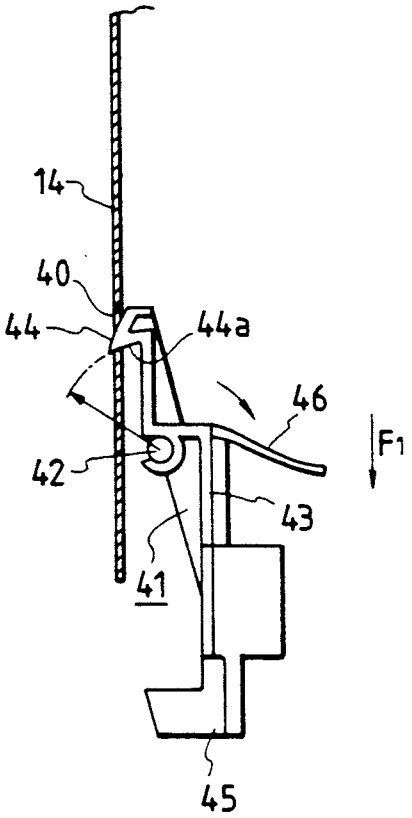
FIG. 2 is a plan view of a modified hook of a holder member.

As shown in FIG. 2, if an engaging surface 44*a* of the hook 44 is either formed into an arcuate surface disposed on a circle having its center disposed the pin 42, or formed into an inclined surface along such an arcuate surface, the holder member 41 is less liable to be pivotally moved in the direction of the arrow even when a withdrawing force F1 acts on the cartridge A, thus increasing the force for holding the print cartridge A by the holder member 41.

Next, a second embodiment will now be described with reference to FIGS. 8 to 11.

Figure 8:
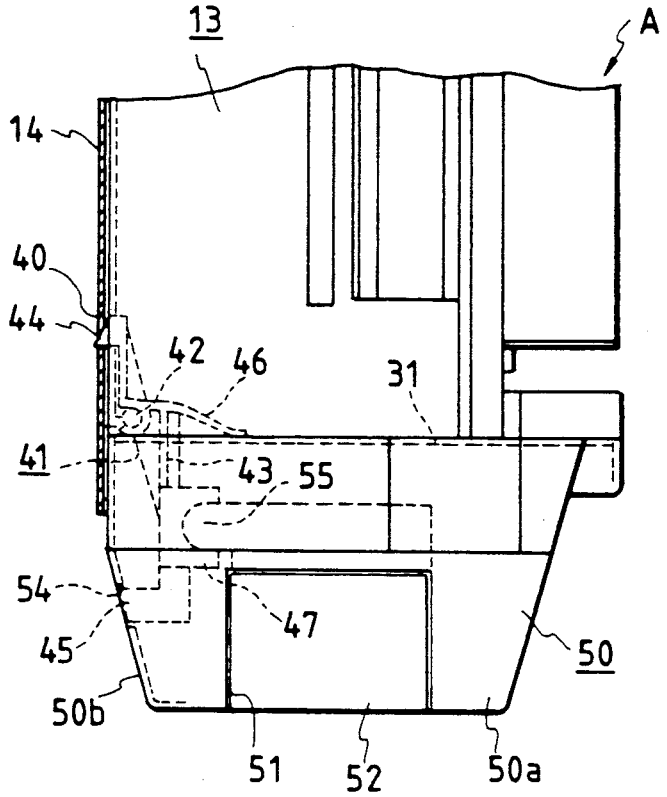
FIG. 8 is a plan view of a second embodiment.
Figure 9:
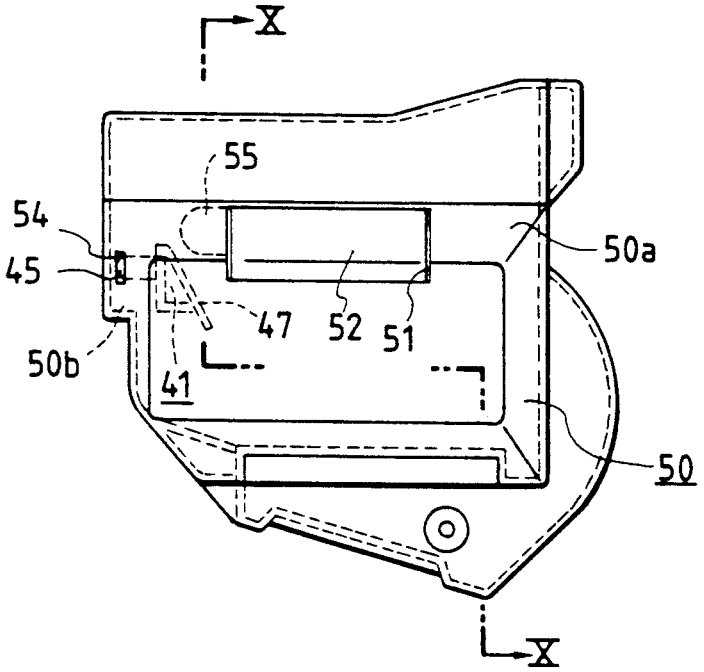
FIG. 9 is a front view thereof.

A cover 50 is mounted on the proximal end portion (for example, the positioning side plate 31) of the housing 13 to cover the holder member 41. The cover 50 is of such a size that it can be held by the hand. A movable member 52 being vertically movably is provided in an opening 51 formed through an upper wall 50*a* of the cover 50. The movable member 52 is urged upward by a spring 53. One end wall 50*b* of the cover 50 has an opening 54 disposed in opposed relation to the operating portion 45 of the holder member 41. A slide piece 55 is formed integrally with the movable member 52, and the slide piece 55 is opposed to a slide surface 47 of the body 43 of the holder member 41 which is inclined relative to the vertical plane. As shown in FIG. 8, when the hook 44 of the holder member 46 is kept engaged in the notched portion 40 of the guide rail 14, the operating portion 45 is received within the cover 50.

Figure 11:
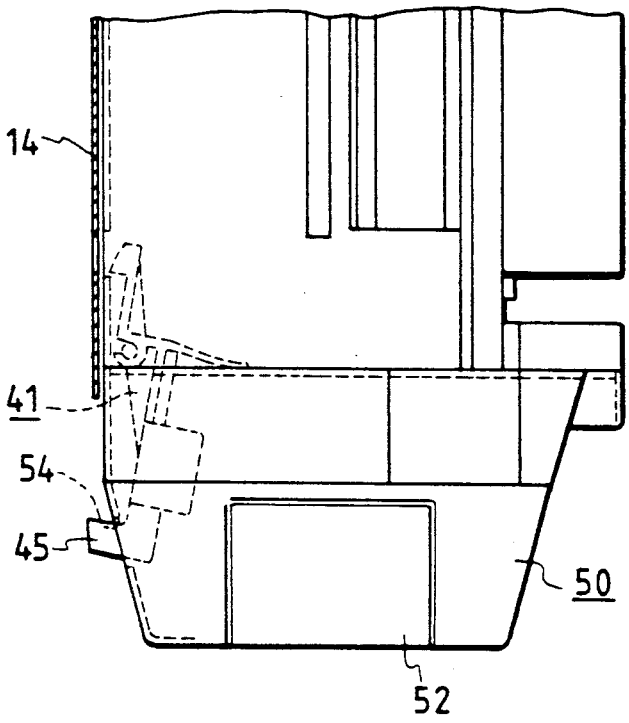
FIG. 11 is a view illustrative of the operation.

When the print cartridge A is to be inserted into the apparatus body 1 as described above, the hook 44 of the holder member 41 slides in contact with the inner surface of the guide rail 14, as shown in FIG. 11, and therefore the holder member 41 is pivotally moved in the direction of the arrow against the bias of the resilient piece 46, so that the operating portion 45 is projected outwardly through the opening 54 of the cover 50. When the print cartridge A is inserted into the predetermined position, the hook 44 is engaged with the notched portion 40, and the holder member 41 is pivotally moved, so that the operating portion 45 is received into the cover 50, as shown in FIG. 8. Therefore, the pushing of the print cartridge A into the predetermined position as a result of the engagement of the hook 44 of the holder member 41 in the notched portion 40 of the guide rail 14 can be recognized from the outside viewing. Thus, the print cartridge A can be attached by positively pushing it into the predetermined position.

Figure 10:
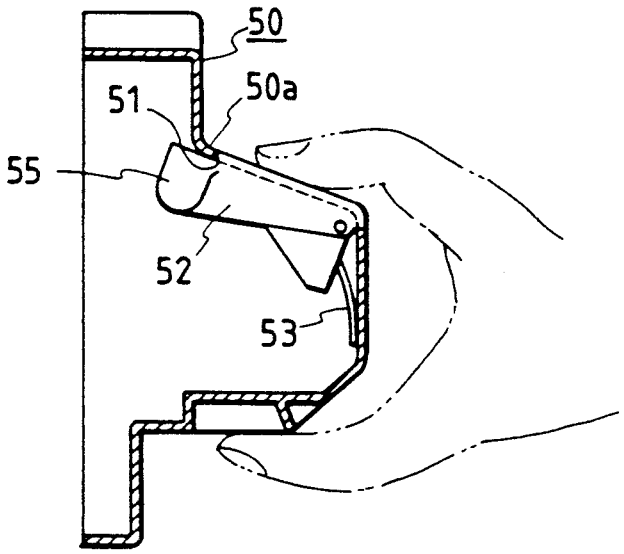
FIG. 10 is a cross-sectional view taken along the line X—X of FIG. 9.

When withdrawing the print cartridge A from the apparatus body, as shown in FIG. 10, the cover 50 is grasped by the hand, and the movable member 52 is pivotally moved downward, so that the slide piece 55 is abutted against the slide surface 47 to pivotally move the holder member 41 in the direction of the arrow. As a result, the hook 44 is disengaged from the notched portion 40, and in this condition the print cartridge A can be withdrawn together with the cover 50. Thus, the operation is very easy.

According to the present invention, the housing 13 can be inserted and withdrawn along the guide rails 14 provided on the apparatus body 1, and therefore the print cartridge A can be easily attached to and detached from the apparatus body 1. And besides, when the print cartridge A is pushed into the predetermined position in the apparatus body 1, and is attached to the apparatus body, the engagement portion of the holder member 41 is engaged with the engaging portion of the guide rail 14 so as to hold the print cartridge A, thereby preventing the withdrawal of the print cartridge A from the apparatus body 1 due to vibration Or the like during the operation.

Further, with respect to the insertion of the print cartridge A into the apparatus body 1, when one portion of the holder member 41 ceases to be projected from the cover 50, the print cartridge is inserted into the predetermined position as a result of the engagement of the engagement portion with the engaging portion. Therefore, by viewing the one portion of the holder member 41, the insertion of the print cartridge A into the predetermined position can be recognized. Therefore, the stopping of the print cartridge halfway is prevented.

Furthermore, by pivotally moving the movable member 52 of the cover 50, the engagement portion can be disengaged from the engaging portion, and therefore the print cartridge A can be withdrawn while grasping the cover 50. This facilitates the operation.

What is claimed is:

1. An image forming apparatus comprising an apparatus body having a guide rail; and a print cartridge movable along said guide rail;

said guide rail having a first engaging portion;

said print cartridge including a holder member and a cover covering said holder member;

said cover having a opening portion; and said holder member having a second engagement portion which is adapted to be pushed so as to be engaged with said first engaging portion, and an operating portion which is responsive to the engagement of said second engagement portion with said first engaging portion so as to be moved into and out of said cover through said opening portion of said cover.

2. An image forming apparatus according to claim 1, wherein said print cartridge has a pin swingably supporting said holder member.

3. An image forming apparatus according to claim 2, wherein said holder member has a resilient piece for urging said engagement portion toward said guide rail.

4. An image forming apparatus according to claim 1, wherein said cover has a movable member for releasing the engagement between said first engaging portion and said second engagement portion.

* * * * *

UNITED STATES PATENT AND TRADEMARK OFFICE

CERTIFICATE OF CORRECTION

PATENT NO. : 5,066,976

DATED : November 19, 1991

INVENTOR(S) : Takashi Kanagawa et al.

It is certified that error appears in the above-identified patent and that said Letters Patent is hereby corrected as shown below:

Claim 1, column 5, line 10, after "having" change "a" to --an--.

Claim 3, column 6, line 10, after "urging said" insert --second--.

Signed and Sealed this

Twenty-second Day of June, 1993

*Attest:*

Michael K. Kirk

MICHAEL K. KIRK

*Attesting Officer*

*Acting Commissioner of Patents and Trademarks*